US008132994B2

(12) United States Patent
Okada et al.

(10) Patent No.: US 8,132,994 B2
(45) Date of Patent: Mar. 13, 2012

(54) BOOKBINDING SYSTEM

(75) Inventors: Hiroki Okada, Kanagawa (JP); Takeshi Sasaki, Tokyo (JP); Shingo Matsushita, Kanagawa (JP); Junichi Iida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 12/382,406

(22) Filed: Mar. 16, 2009

(65) Prior Publication Data

US 2009/0232622 A1 Sep. 17, 2009

(30) Foreign Application Priority Data

Mar. 17, 2008 (JP) ..... 2008-067362
Sep. 26, 2008 (JP) ..... 2008-247942

(51) Int. Cl.

| | |
|---|---|
| ***B42C 9/00*** | (2006.01) |
| ***B42C 13/00*** | (2006.01) |
| ***B42C 11/00*** | (2006.01) |
| ***B42B 5/08*** | (2006.01) |
| ***B42B 9/00*** | (2006.01) |
| ***B42B 5/00*** | (2006.01) |
| ***B42B 5/06*** | (2006.01) |
| ***B42B 5/10*** | (2006.01) |

(52) U.S. Cl. ..... 412/14; 412/1; 412/6; 412/7; 412/9; 412/12; 412/16; 412/18; 412/20; 412/33; 412/34; 412/38; 412/39; 412/40; 412/42

(58) Field of Classification Search ..... 412/1, 6, 412/7, 9, 11, 12, 14, 16, 18, 20, 33, 34, 38, 412/39, 40, 42

See application file for complete search history.

(56) References Cited

U.S. PATENT DOCUMENTS

| | | | | |
|---|---|---|---|---|
| 5,090,860 | A * | 2/1992 | Matsuo et al. | 412/11 |
| 6,549,734 | B2 | 4/2003 | Yamada et al. | |
| 7,137,625 | B2 | 11/2006 | Yamada et al. | |
| 7,407,155 | B2 | 8/2008 | Tamura et al. | |
| 7,410,158 | B2 | 8/2008 | Iida et al. | |
| 7,458,567 | B2 | 12/2008 | Yamada et al. | |
| 2004/0256783 | A1 | 12/2004 | Iida et al. | |
| 2006/0022394 | A1 | 2/2006 | Tamura et al. | |

(Continued)

FOREIGN PATENT DOCUMENTS

| | | |
|---|---|---|
| JP | 63-041373 | 2/1988 |

(Continued)

OTHER PUBLICATIONS

An English language abstract of Japanese Publication No. 3-063192, published Mar. 19, 1991.

*Primary Examiner* — Dana Ross
*Assistant Examiner* — Justin Lewis
(74) *Attorney, Agent, or Firm* — Harness, Dickey & Pierce, P.L.C.

(57) ABSTRACT

A punching processing unit punches holes in a paper bundle delivered from a preprocessing device. A bookbinding unit includes a cartridge for stocking a plurality of rings, and performs a ring binding by binding the paper bundle with the rings. A detecting unit detects an abnormality of a ring in the cartridge. A control unit exchanges a signal with the preprocessing unit each time when detection information obtained by the detecting unit changes. When any one of the rings is determined as abnormal and an execution of ring binding is set, the control unit inhibits the ring binding.

19 Claims, 11 Drawing Sheets

U.S. PATENT DOCUMENTS

| | | | | |
|---|---|---|---|---|
| 2007/0035079 | A1 | 2/2007 | Yamada et al. | |
| 2008/0075560 | A1 * | 3/2008 | Kurabayashi et al. | 412/38 |

FOREIGN PATENT DOCUMENTS

| | | |
|---|---|---|
| JP | 3-153393 | 7/1991 |
| JP | 7-069525 | 3/1995 |
| JP | 2723987 | 11/1997 |
| JP | 2005-017692 | 1/2005 |
| JP | 2007-030319 | 2/2007 |
| JP | 2007-031068 | 2/2007 |
| JP | 2007-055179 | 3/2007 |

* cited by examiner

BOOKBINDING SYSTEM

CROSS-REFERENCE TO RELATED APPLICATIONS

The present application claims priority to and incorporates by reference the entire contents of Japanese priority document 2008-067362 filed in Japan on Mar. 17, 2008 and Japanese priority document 2008-247942 filed in Japan on Sep. 26, 2008.

BACKGROUND OF THE INVENTION

1. Field of the Invention

The present invention relates to a technology for binding a paper bundle delivered from a preprocessing device.

2. Description of the Related Art

In connection with a post-processing apparatus connected to an image forming device as a preprocessing device, the following functions are generally known: a function of binding an lateral side end or a lateral side center of a paper bundle with a staple upon receiving a paper bundle delivered from the preprocessing device; a function of performing bookbinding by pressing paper ends onto a sticky tape; and as another bookbinding function, a function of finishing a ring-bound book by punching a plurality of holes on a binding side of a paper bundle, and then binding the paper bundle with a metal coil or plastic rings.

As a paper post-processing apparatus that performs binding processing of a paper bundle with staples, there are apparatuses as described in Japanese Patent Application Laid-open No. S63-41373, Japanese Patent Application Laid-open No. H3-153393, Japanese Patent No. 2723987, Japanese Patent Application Laid-open No. H7-69525, and Japanese Patent Application Laid-open No. 2005-17692, and proposed is a configuration designed to prevent occurrence of a defect in staple processing.

According to a ring bookbinding apparatus used as a post-processing apparatus (see, Japanese Patent Application Laid-open No. 2007-30319, Japanese Patent Application Laid-open No. 2007-31068, and Japanese Patent Application Laid-open No. 2007-55179), rings made from a metal coil or plastic are used, and a user refills rings into a ring cartridge in accordance with consumption of rings.

When setting rings into the cartridge, the rings need to be set by selecting a ring size and a type of ring diameter in accordance with a purpose of bookbinding. There is a possibility of occurrence of a trouble that, for example, the rings are set upside down mistakenly, or rings in the cartridge run out during processing.

A paper bundle of which ring bookbinding is once finished is sometimes added with a sheet of paper by temporarily opening rings in some cases. For this reason, there is a ring bookbinding apparatus configured to accept a mode of performing only punching processing in which paper is delivered by punching a plurality of punch holes in the paper.

In such case, a sheet of paper to be added needs to be punched with a plurality of punch holes appropriate to the size of rings used in the finished ring bookbinding.

Troubles, for example, a mistaken set by user when setting rings in a cartridge, and a shortage of rings during processing, also need to be coped with.

SUMMARY OF THE INVENTION

It is an object of the present invention to at least partially solve the problems in the conventional technology.

According to one aspect of the present invention, there is provided a bookbinding system including a preprocessing device and a ring bookbinding device that receives a paper bundle delivered from the preprocessing device, punches a plurality of holes on a binding side of the paper bundle, and performs a ring binding by inserting a ring into each of the holes. The ring binding device includes a punching processing unit that punches the holes in the paper bundle, a bookbinding unit that includes a cartridge for stocking a plurality of rings, and performs a ring binding by binding the paper bundle with the rings, a detecting unit that detects an abnormality of a ring in the cartridge, and a control unit that exchanges a signal with the preprocessing unit each time when detection information obtained by the detecting unit changes. When any one of the rings is determined as abnormal and an execution of ring binding is set, the control unit inhibits the ring binding.

Furthermore, according to another aspect of the present invention, there is provided a bookbinding system including a preprocessing device and a ring bookbinding device that receives a paper bundle delivered from the preprocessing device, punches a plurality of holes on a binding side of the paper bundle, and performs a ring binding by inserting a ring into each of the holes. The ring binding device includes a punching processing unit that punches the holes in the paper bundle, a bookbinding unit that includes a cartridge for stocking a plurality of rings, and performs a ring binding by binding the paper bundle with the rings, a detecting unit that detects an abnormality of a ring in the cartridge, and a control unit that exchanges a signal with the preprocessing unit each time when detection information obtained by the detecting unit changes. When any one of the rings is determined as abnormal and an execution of ring binding is set, the control unit displays a message saying punching processing function only on a display unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
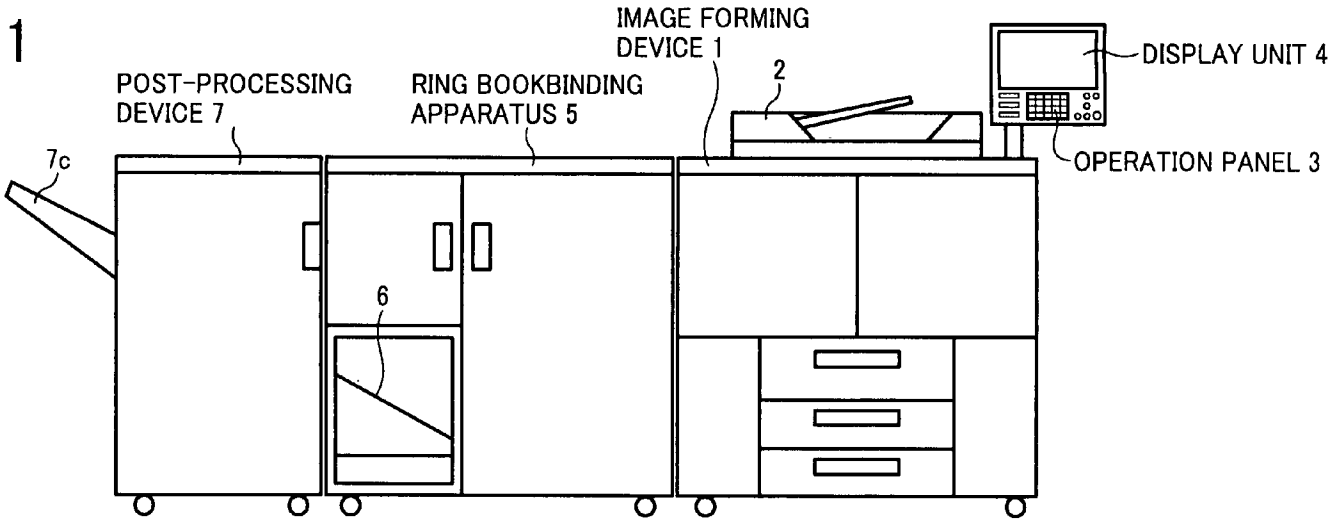
FIG. 1 is a schematic diagram of an appearance of the whole of a bookbinding system according to an embodiment of the present invention.

In FIG. 1, a reference numeral 1 denotes an image forming device as a preprocessing device that includes multi-functions, such as a function of photocopier. A reference numeral 2 denotes an automatic document feeder that is placed on the upper part of the image forming device 1, and feeds an original. A reference numeral 3 denotes an operation panel that is provided on the image forming device 1, and includes a display unit 4 that receives input of various setting modes and displays a state of various operations and information. A reference numeral 5 denotes a ring bookbinding apparatus that is connected to the image forming device 1, and receives paper discharged from the image forming device 1. A reference numeral 6 denotes a ring-bound book delivery tray that is provided inside the ring bookbinding apparatus 5, and receives delivery of a booklet that is a bundle of paper bound with rings. A reference numeral 7 denotes a post-processing device that is connected to the ring bookbinding apparatus 5, capable to perform, such as staple binding and alignment of paper, and provided with an external paper-delivery tray 7*c* to which processed paper is delivered.

Figure 2:
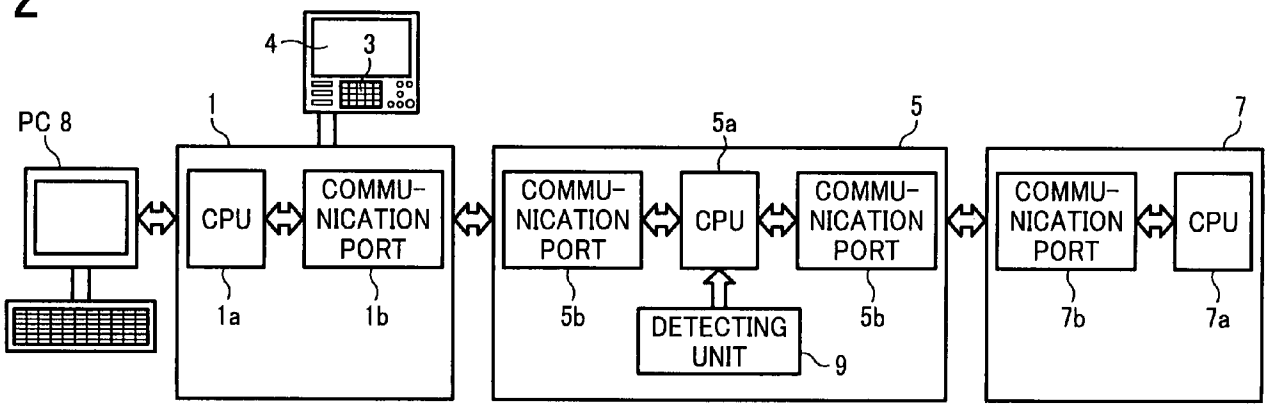
FIG. 2 is a schematic diagram that depicts relevant configurations of control/communication systems of the bookbinding system according to the embodiment.

In FIG. 2, the image forming device 1, the ring bookbinding apparatus 5, and the post-processing device 7 include central processing units (CPU) 1*a*, 5*a*, and 7*a*, and output and receive data via communication ports 1*b*, 5*b*, and 7*b*, respectively.

Moreover, the image forming device 1 configured to be conned to a personal computer (PC) 8 and to function as a printer. The ring bookbinding apparatus 5 includes a detecting unit 9 that is a sensor that constantly monitors, for example, presence of rings, a set state, and a size.

Figure 3:
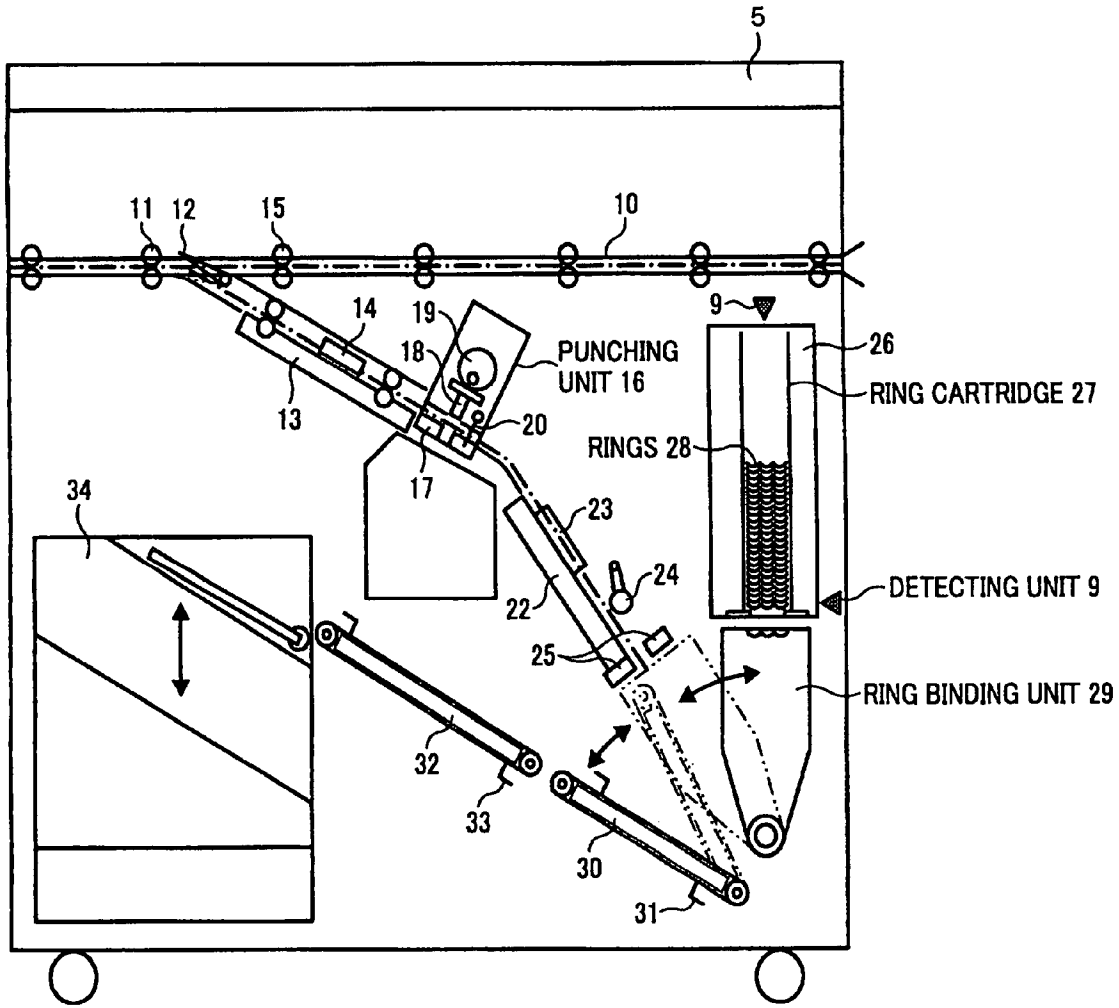
FIG. 3 is a schematic diagram of a ring bookbinding apparatus according to the embodiment.

A configuration and operation of the ring bookbinding apparatus 5 is explained below with reference to FIG. 3.

Paper sent from the image forming device 1 is carried on a horizontal delivery path 10. When the ring bookbinding apparatus 5 is being set via the operation panel 3 not to bind paper with rings, paper is horizontally carried as it is, and delivered to the post-processing device 7 arranged downstream on the delivery path. When a mode is being set to perform ring binding, paper is switched back by a reverse roller 11 placed downstream on the horizontal delivery path. When switching back, a switch nail 12 is switched, and then paper is carried to the direction of a punching unit 16 arranged diagonally below the switch nail 12.

On the way to the punching unit 16, lateral sides of paper are aligned in an alignment tray 13 by a jogger 14 for aligning a paper bundle, and the paper is pushed to a tip push stopper 20, so that the positions of the lateral sides and the carrying direction sides of the paper are aligned. When pushing paper to the tip push stopper 20, damage on paper tip is reduced by giving a carrying force with carrying rollers 15 provided with a torque limiter.

After the paper is aligned, a cam 19 inside the punching unit 16 rotates and presses down a punch 18, so that holes are punched in the paper between the punch 18 and a die 17. The punching unit 16 is configured to punch multiple holes for ring binding. The paper with punched holes is released from the tip push stopper 20, carried further downstream on the delivery path, and then delivered to an alignment tray 22.

The alignment tray 22 receives a number of sheets of paper to be made into a booklet sheet by sheet, and piles them up by aligning them. The alignment tray 22 is provided with a lateral-alignment jogger 23 and a patting roller 24 that presses paper to the paper delivery direction, so that the lateral sides of the paper are aligned by the lateral-alignment jogger 23, while the delivery direction side of the paper is aligned with a not-shown fence. After the number of sheets of paper to be made into a booklet is piled on the alignment tray 22, the vicinity of a binding side of a paper bundle of is held with pressure by a clump 25.

A ring cartridge 27 is accommodated inside a ring-cartridge storage unit 26 placed on a lateral side of the alignment tray 22, and a number of rings 28 are stacked in the ring cartridge 27. According to the embodiment, plastic rings of a type of which circumference is divided into three are used. The detecting unit 9 provided at an appropriate position detects various information about the rings 28 in the ring cartridge 27.

A ring binding unit 29 pivotably arranged below the ring cartridge 27 receives the rings 28 by pivoting to the underneath of the ring cartridge 27. The ring binding unit 29 holding a length of the rings 28 pivots to the underneath of the clump 25, and draws the rings 28 through holes punched on the lower end of the paper bundle, and then a not-shown binding mechanism performs ring binding.

After a bundle carrying unit 30 that is pivotable pivots to the underneath of the clump 25, a booklet bound with rings is released from the clump 25, received by a discharging nail 31 that is provided on a belt included in the bundle carrying unit 30, and then transferred onto the bundle carrying unit 30. The bundle carrying unit 30 then pivots counterclockwise, and moves to a position located on the substantially same straight line as a final bundle-carrying unit 32. The booklet is then passed to the final bundle-carrying unit 32 with the discharging nail 31.

The booklet is carried on the final bundle-carrying unit 32 with a discharging nail 33 that is provided on a belt included in the final bundle-carrying unit 32, and then delivered to a stack tray 34 that is provided inside the ring bookbinding apparatus 5.

When a mode is being set to perform only punching holes; after the punching unit 16 punches holes in paper, a paper bundle is piled up and aligned on the alignment tray 22, clump operation with the clump 25 is omitted, and then after the bundle carrying unit 30 pivots and moves to the underneath of the clump 25, the paper bundle is released from the clump 25, received by the discharging nail 31, and transferred onto the bundle carrying unit 30. The bundle carrying unit 30 then pivots counterclockwise, and passes the paper bundle to the final bundle-carrying unit 32 with the discharging nail 31. The paper bundle is carried by the final bundle-carrying unit 32 with the discharging nail 33, and delivered to the stack tray 34.

As described above, according to the ring bookbinding apparatus 5, when setting the rings 28 into the ring cartridge 27, the rings 28 need to be set by selecting a ring size and a type of ring diameter in accordance with a purpose of bookbinding. There is a possibility of occurrence of a trouble that, for example, the rings 28 are set upside down mistakenly, or a remaining amount of rings in the cartridge becomes insufficient or runs out during processing.

When a user sets a mode of performing only punching holes in which paper is delivered by punching a plurality of holes in the paper to add a sheet of paper to a booklet on which ring bookbinding is completed, a size of the paper needs to fit with a punch size to be made by the punching unit 16.

For this reason, according to the embodiment, the ring bookbinding apparatus 5 is configured as described below to avoid a trouble that may occur when setting a mode of ring bookbinding and punching holes.

The ring bookbinding apparatus 5 is provided with the detecting unit 9 for detecting a set state, remaining amount information, size information, and ring diameter, of the rings 28 stored in the ring cartridge 27, and configured to receive detection information obtained by the detecting unit 9 with the CPU 5*a*, and to output the received information to the CPU 1*a*, so that the output information is compared with information about, for example, mode setting.

In other words, the CPU 1*a* determines whether a mode setting condition agrees with detection information, and if it does not agree, it is determined that the rings are abnormal. The CPU 1*a* controls the image forming device 1 to cause the display unit 4 to display a result of the determination. The CPU 5*a* outputs detection information obtained by the detecting unit 9 to the CPU 1*a* each time when the detection information changes.

A concrete example of detection of rings performed by the detecting unit 9 and the CPU 5*a* is explained below.

Figure 4:
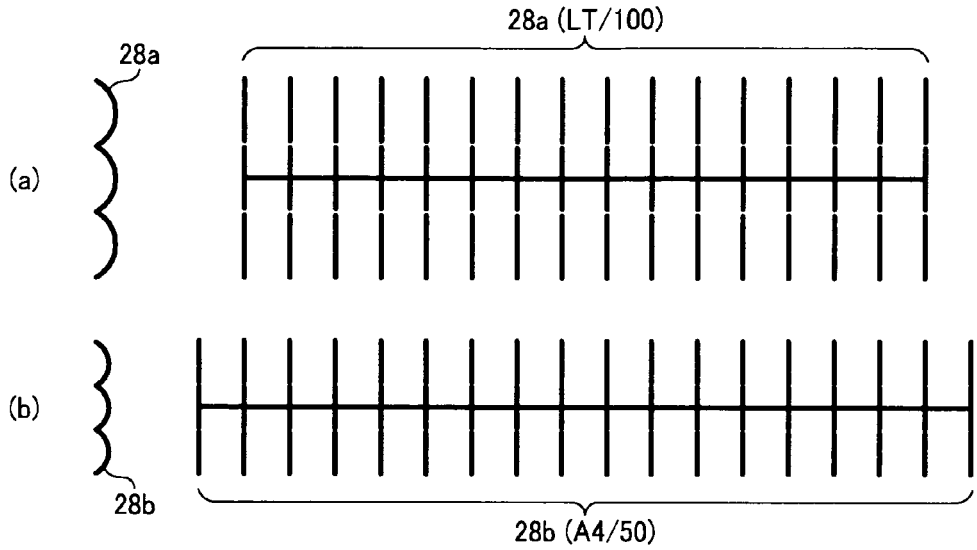
FIG. 4 is a schematic diagram for explaining a configuration example of rings to be used according to the embodiment.

The right part of each of sections (a) and (b) of FIG. 4 is a plan view of rings, and the left part is a side view of rings. Section (a) of FIG. 4 depicts a length of rings 28*a* for 100-sheet binding of paper in letter (LT) size, and section (b) of FIG. 4 depicts a length of rings 28*b* for 50-sheet binding of paper in A4 size.

Each length of the rings 28*a* and 28*b* is made of connected concave rings, and has a length and a width (height) different from the other. Distinction between the rings can be detected by detecting such differences.

Figure 5:
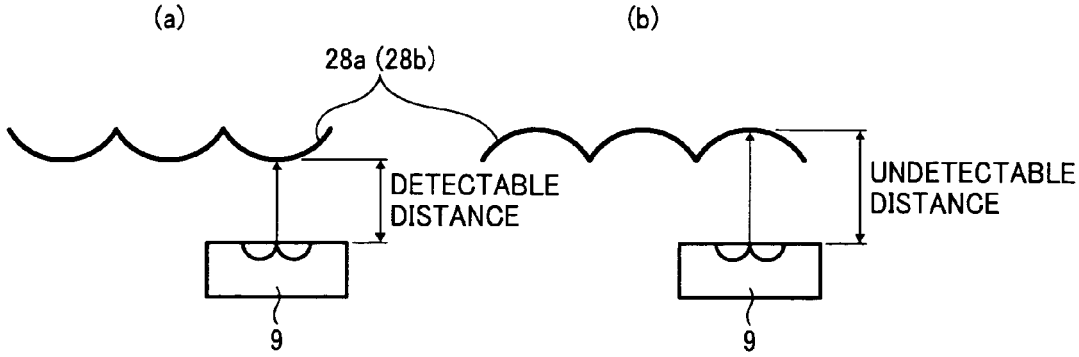
FIG. 5 is a schematic diagram for explaining set-error detection on rings according to the embodiment.

As shown in section (a) of FIG. 5, a normal set is a state where a concave of the rings 28*a* or 28*b* face upward, and the detecting unit 9 that includes a light-receiving element and a light-emitting element is set able to detect the rings 28*a* or 28*b* set in the normal set.

In this way, when the detecting unit 9 detects an outer side of the concave projecting from the rings 28*a* or 28*b*, it is determined as normal-set detection. By contrast, as shown in section (b) of FIG. 5*b*, when the rings 28*a* or 28*b* are set in reverse, an inner side of the concave is further departed from the detecting unit 9, thereby being at an undetectable distance from the detecting unit 9. When the rings 28*a* or 28*b* are at an undetectable distance, it is determined as erroneous-set detection.

Figure 6:
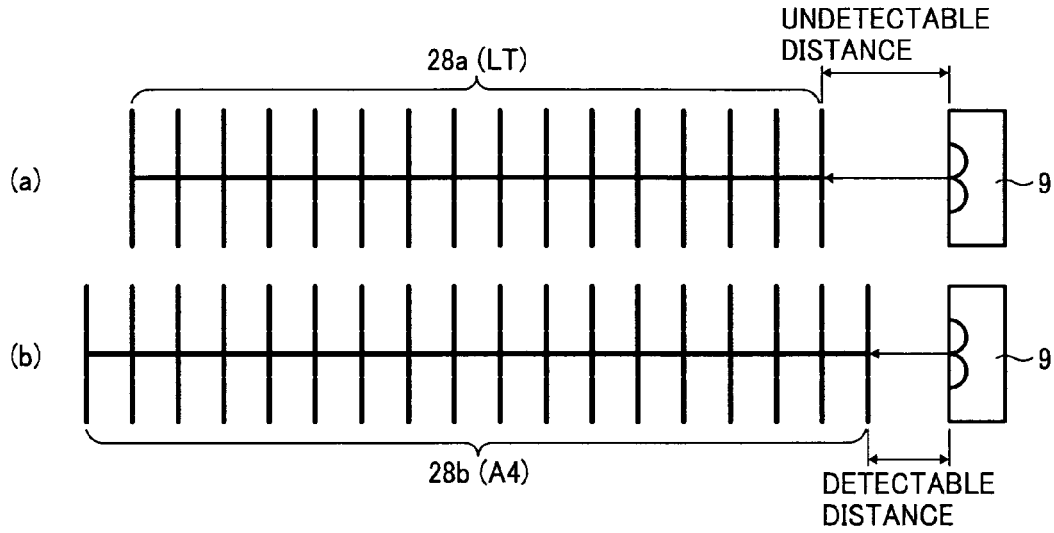
FIG. 6 is a schematic diagram for explaining ring-type detection according to the embodiment.

As shown in section (a) of FIG. 6, the length of the rings 28*a* in LT size is configured to be shorter than that of the rings 28*b* in A4 size. To detect a difference between the lengths, the detecting unit 9 is set at an undetectable distance from the end of the rings 28*a* in LT size, and at a detectable distance from the end of the rings 28*b* in A4 size.

In this way, because of the detectable/undetectable distances for the detecting unit 9, the detecting unit 9 can detect the types of the rings 28*a* and 28*b* stored in the ring cartridge 27.

Figure 7:
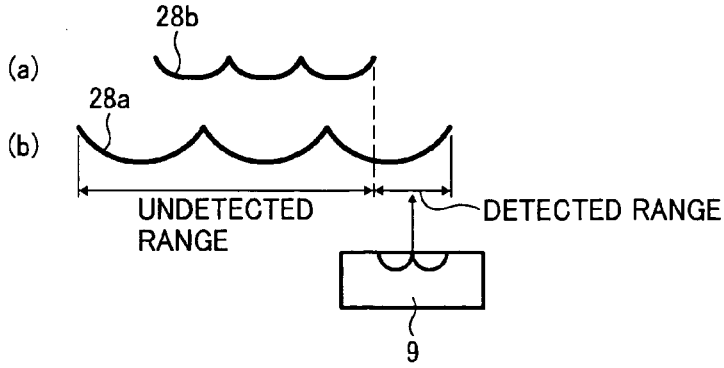
FIG. 7 is a schematic diagram for explaining ring-type detections according to the embodiment that vary depending on the number of sheets of paper to be bound.

The width of the rings 28*b* for 50-sheet paper binding shown in section (a) of FIG. 7 is configured to be shorter than that of the rings 28a for 100-sheet paper binding. To detect a difference between the widths, the detecting unit 9 is placed such that the end of the rings 28*a* having a wide width for 100-sheet paper binding comes in a range able to detect, and the rings 28*b* having a narrow width for 50-sheet paper binding comes in an undetected range.

In this way, because of the detectable/undetectable range for the detecting unit 9, the detecting unit 9 can detect the types of the rings 28*a* and 28*b* stored in the ring cartridge 27.

As the CPU 5*a* detects various pieces of information on the rings 28*a* and 28*b* obtained by the detecting unit 9 in appropriate combination, detection of a ring set in each of various states is performed.

A display configuration and display examples on the display unit 4 according to the embodiment are explained below.

Figure 8:
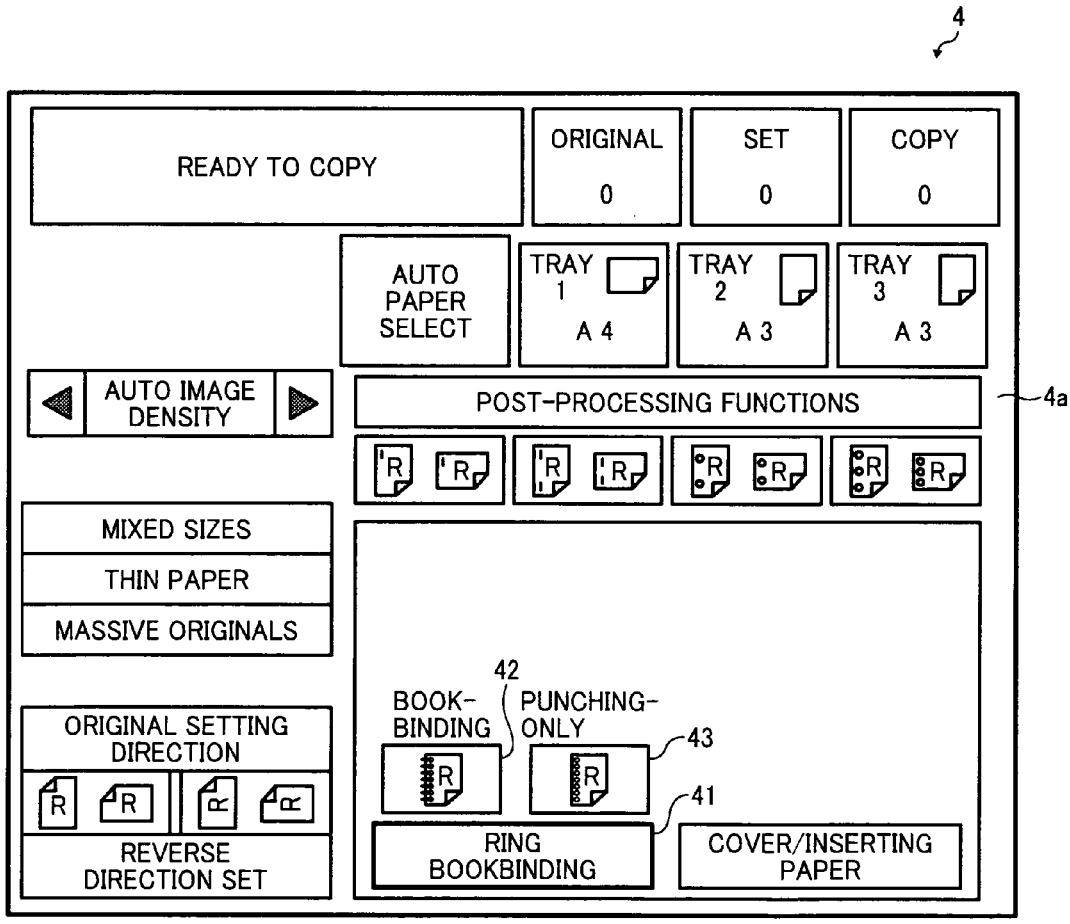
FIG. 8 is a schematic diagram for explaining a display configuration on a display unit according to the embodiment.

As shown in FIG. 8, the display unit 4 is caused to display a ring-bookbinding key 42 and a punching-only key 43 for on-line on an operation screen 4*a*, by selecting a ring bookbinding key 41 (a bold frame indicates a selected state) on the operation screen 4*a*.

Figure 9:
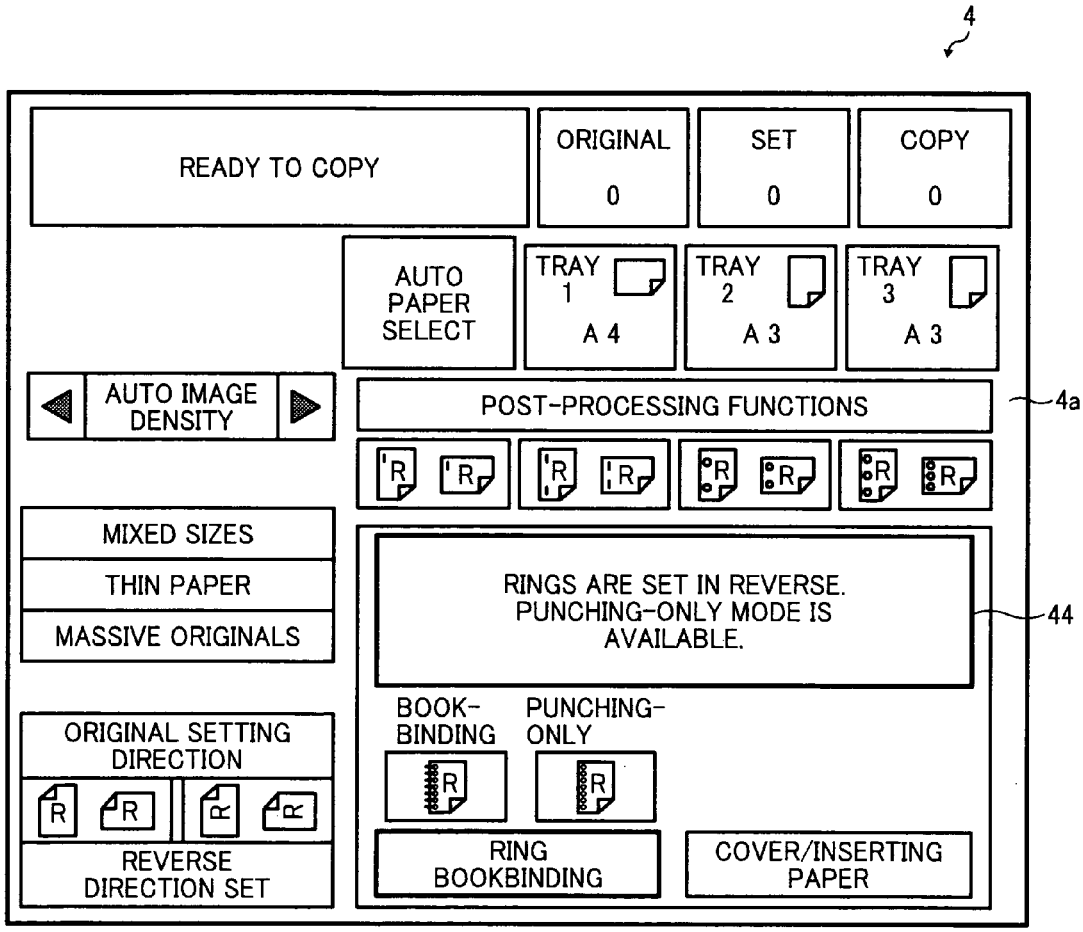
FIG. 9 is a schematic diagram for explaining a display example on the display unit according to the embodiment.

When a user selects the ring-bookbinding key 42, if the rings 28 are set in reverse according to information about the rings 28 in the ring cartridge 27 preliminarily detected and sent by the detecting unit 9, the display unit 4 is caused to display messages 44 meaning that bookbinding is not available because rings are set in reverse, and also meaning that only punching is available, as shown in FIG. 9, thereby allowing the user to make an operational decision smoothly and appropriately.

Figure 10:
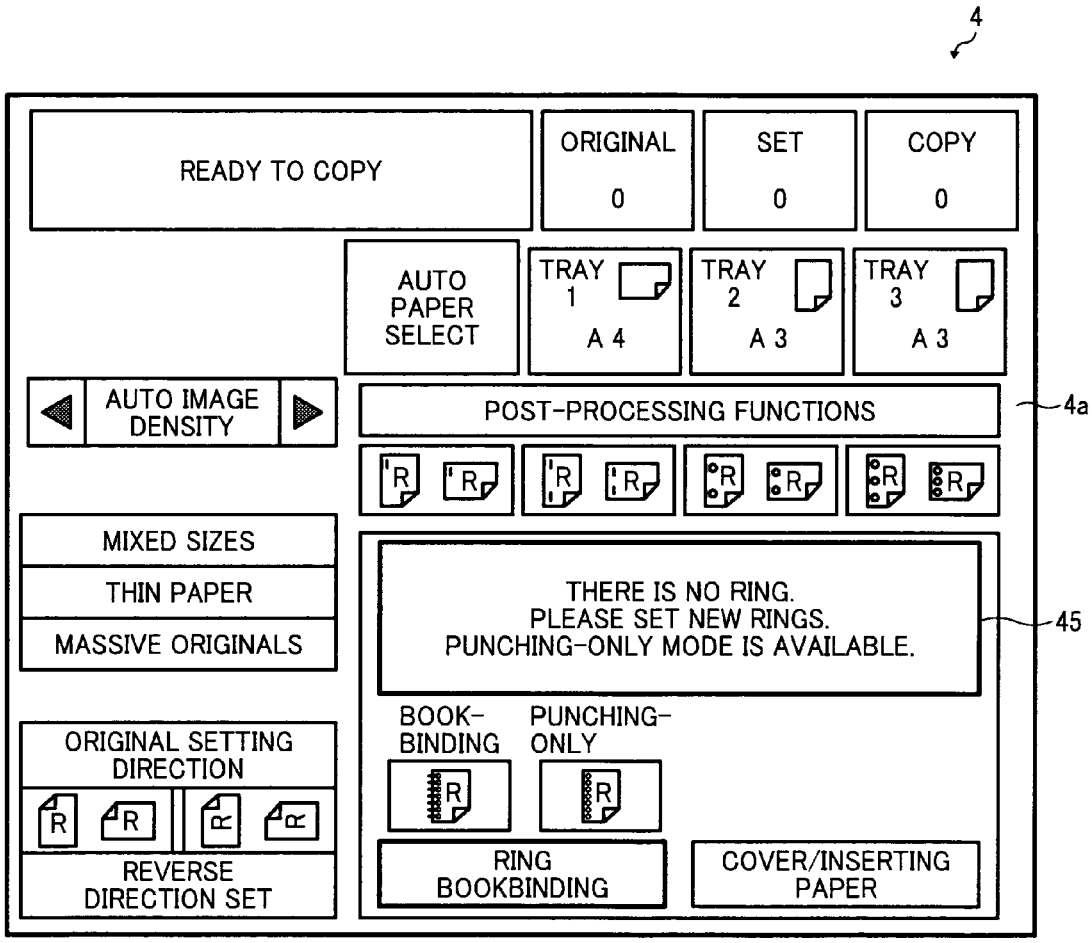
FIG. 10 is a schematic diagram for explaining another display example on the display unit according to the embodiment.

If no remaining amount of the rings 28 according to information about rings in the ring cartridge 27, the display unit 4 is caused to display messages 45 meaning that bookbinding is not available because of no ring, and also meaning that only punching is available, as shown in FIG. 10.

Figure 11:
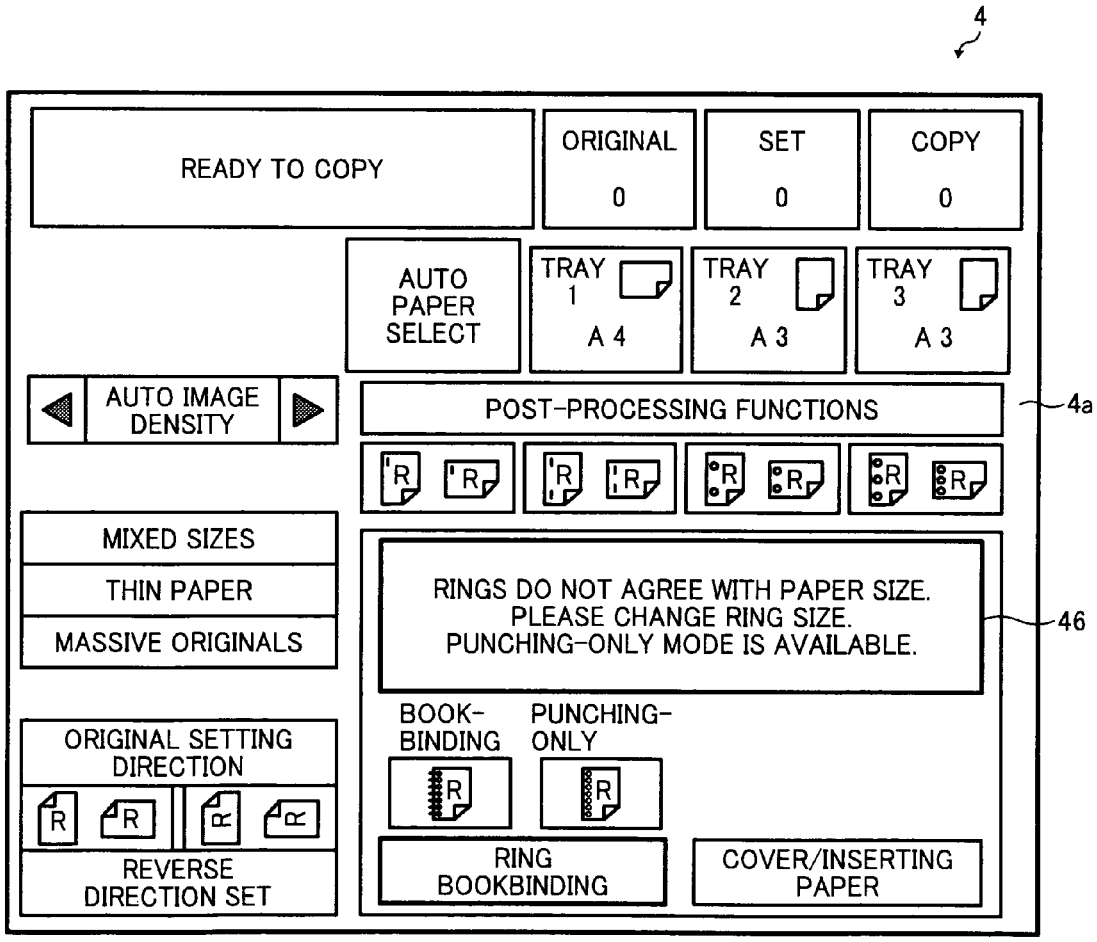
FIG. 11 is a schematic diagram for explaining still another display example on the display unit according to the embodiment.

If bookbinding is not available because the rings 28 do not agree with punch holes in size according to information on rings in the ring cartridge 27 and size information from the punching unit 16, and a paper size selected by the user agrees with a size set in the punching unit 16; the display unit 4 is caused to display messages 46 meaning that bookbinding is not available because rings do not agree with punch holes in size, and also meaning that only punching is available, as shown in FIG. 11.

Figure 12:
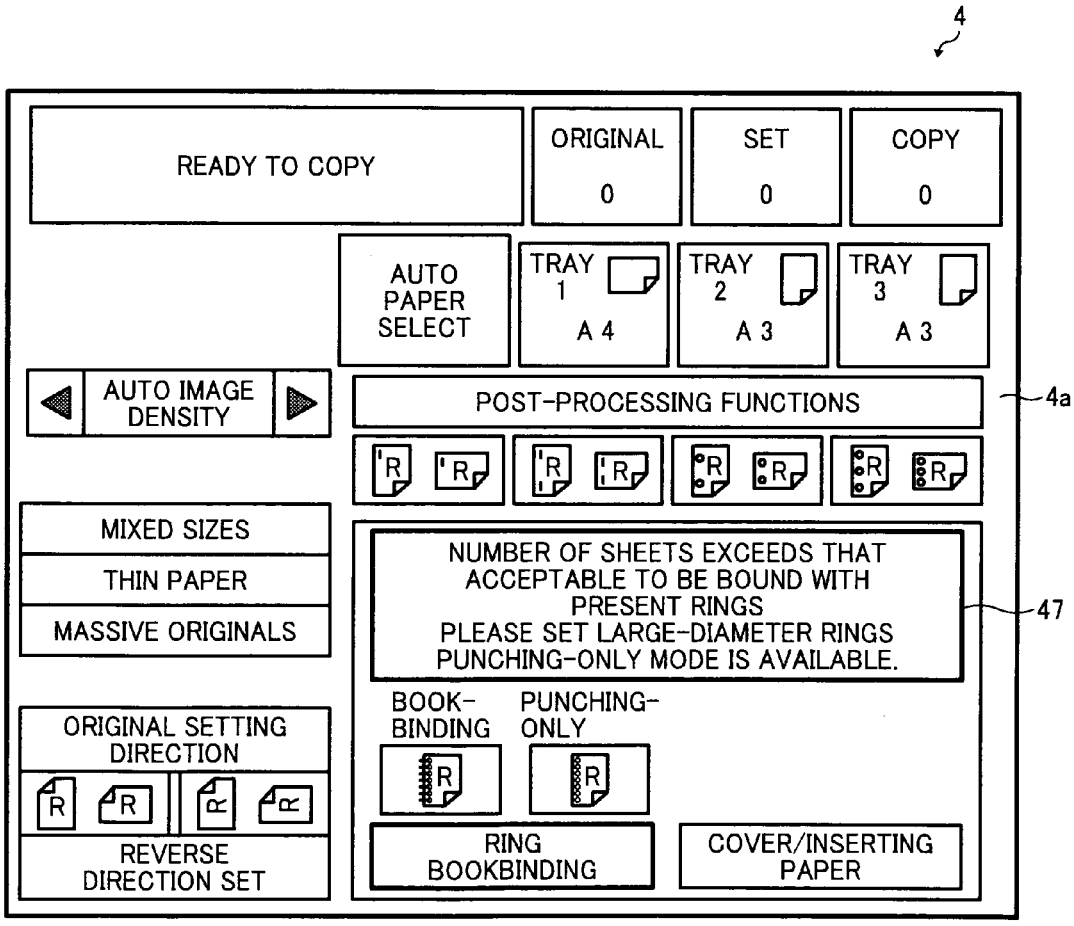
FIG. 12 is a schematic diagram for explaining still another display example on the display unit according to the embodiment.

If the number of sheets of paper to be printed is to exceed during ring bookbinding the upper limit of the number of sheets in volume information (for example, rings for 50 sheets) acceptable to be bound with the rings 28 in the ring cartridge 27, each unit is suspended before exceeding the upper limit, and then the display unit 4 is caused to display messages 47 meaning that bookbinding is not available unless changing ring diameter because the number of sheets exceeds an acceptable number of sheets for bookbinding, and also meaning that only punching is available, as shown in FIG. 12.

An operation flow according to the embodiment is explained below with reference to FIGS. 13 and 14.

Figure 13:
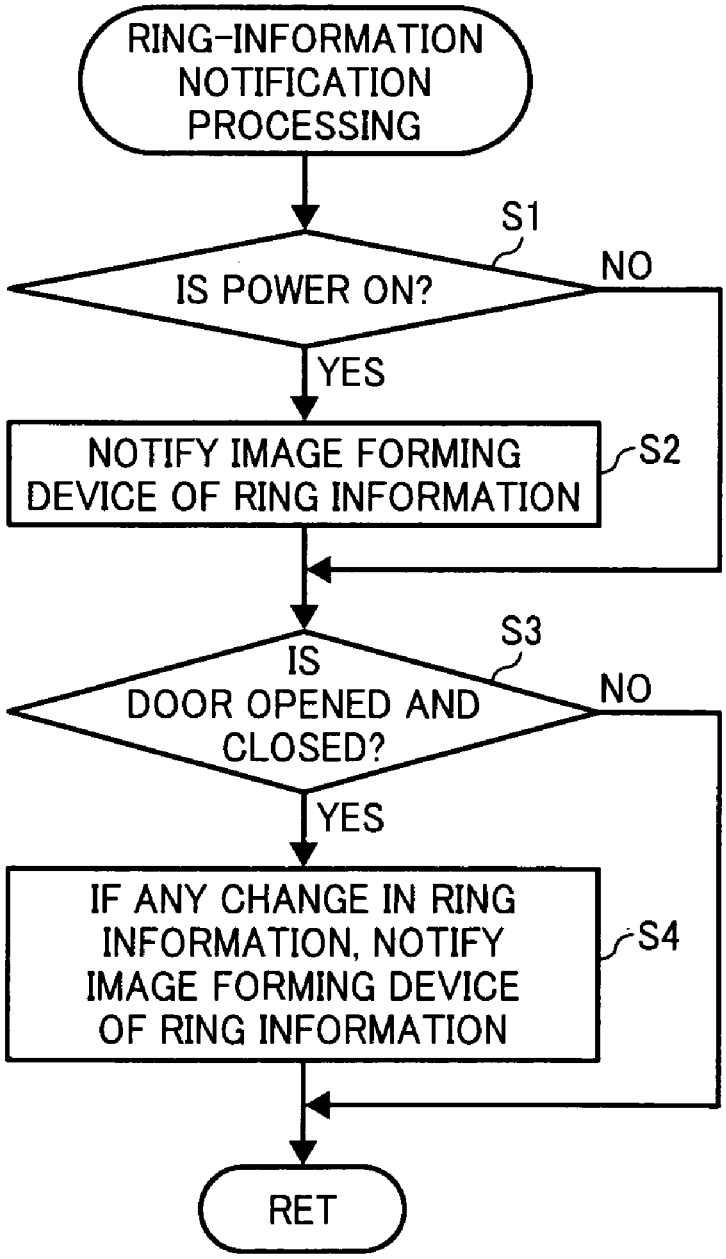
FIG. 13 is a flowchart of ring-information notification processing to an image forming device from the ring bookbinding apparatus according to the embodiment.

As shown in FIG. 13, when the whole system is powered on (Step S1), ring information detected by the detecting unit 9 is output (notified) to the CPU 1*a* via the CPU 5*a* (Step S2). When a door of the body of the ring bookbinding apparatus 5 or the ring cartridge 27 is opened and closed (Step S3), and as a result of detection performed by the detecting unit 9, ring information has been changed, the information is similarly notified to the CPU 1*a* (Step S4).

Figure 14:
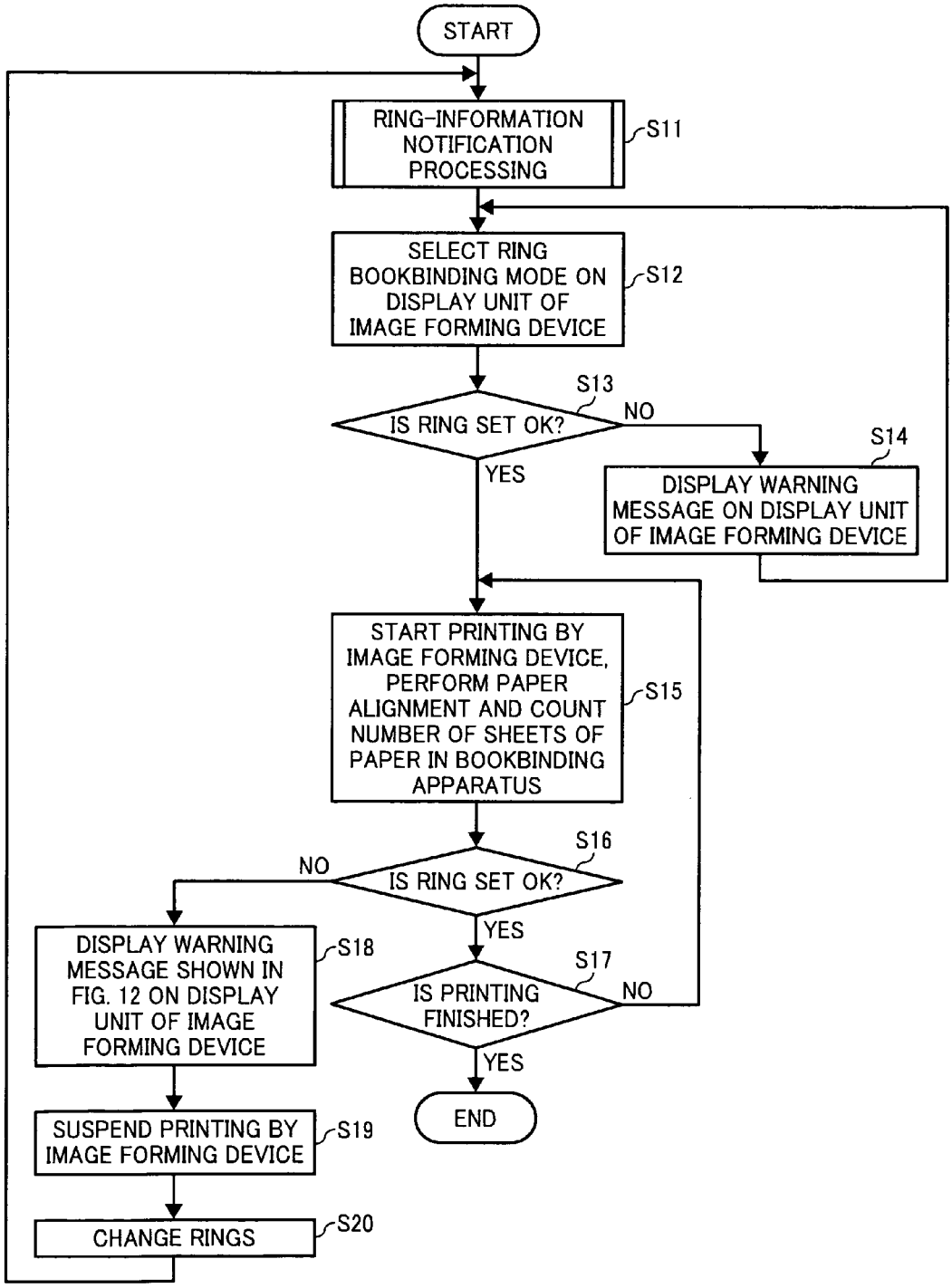
FIG. 14 is a flowchart of bookbinding/display processing according to the embodiment.

As shown in FIG. 14, ring information is notified to the image forming device 1 one after another according to the flow shown in FIG. 13 (Step S11). As described above, when the ring bookbinding mode is selected on the operation screen 4*a* (Step S12), the CPUs 1*a* and 5*a* perform comparison of ring information (consumable information) with, for example, a paper size, and determine whether a ring set state is appropriate; and if inappropriate (No at Step S13), a warning message is displayed as shown in one of FIGS. 9 to 11 (Step S14).

When the image forming device 1 starts image forming operation (printing), the image forming device 1 performs paper alignment and counting the number of sheets of paper on each of which an image is formed (Step S15). The counted number of sheets of paper is then compared with the size of the rings 28, as a result, if the size of the rings 28 is capable to bind the paper (Yes at Step S16), ring bookbinding is performed after printing of all pages are completed (Step S17). When the number of sheets of printed paper exceeds an acceptable amount for the rings 28 to bind paper (No at Step S16), a warning message is displayed as shown in FIG. 12 (Step S18), and at the same time, printing operation performed by the image forming device 1 is suspended (Step S19). The user sets appropriate rings while suspending the image forming device 1 in response to the warning message (Step S20). Ring information about the setting is notified to the image forming device 1 (Step S11). Displayed Contents on a screen of the display unit 4 can be described on a display screen of the PC 8. Moreover, a display unit is provided on the ring bookbinding apparatus 5 and/or the post-processing device 7, the display unit can be configured to display contents similar to the displayed contents on a screen of the display unit 4.

According to one aspect of the present invention, it is possible to make a measure determination immediately and improve workability and operationality of ring bookbinding and punching, thereby achieving practical effects in a large extent.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A bookbinding system including a preprocessing device and a ring bookbinding device that receives a paper bundle delivered from the preprocessing device, punches a plurality of holes on a binding side of the paper bundle, and performs a ring binding by inserting a ring into each of the holes, wherein the ring binding device includes a punching processing unit to punch the holes in the paper bundle, a bookbinding unit, including a cartridge for stocking a plurality of rings, to perform a ring binding by binding the paper bundle with the rings, a detecting unit to detect an abnormality of a ring in the cartridge, and a control unit to exchange a signal from the detecting unit with a preprocessing control unit of the preprocessing device for comparison with a setting condition in the preprocessing control unit each time when detection information obtained by the detecting unit changes, and when any one of the rings is determined as abnormal based on a result of the comparison and an execution of ring binding is set, the control unit inhibits the ring binding.

2. The bookbinding system according to claim 1, wherein when a setting condition of the ring binding does not match with the detection information obtained by the detecting unit, it is determined as the abnormality of the ring.

3. The bookbinding system according to claim 1, wherein the detecting unit is configured to detect at least one piece of information among a set state, remaining-amount information, size information, and a ring diameter of the rings in the cartridge as a subject of detection of the abnormality of the ring.

4. The bookbinding system according to claim 1, wherein when the control unit inhibits the ring binding, the control unit allows the punching processing to be executed.

5. The bookbinding system according to claim 1, wherein when the control unit inhibits the ring binding, the control unit displays a message of inhibition on a display unit or performs a notification with a sound output from a sounding unit.

6. The bookbinding system according to claim 1, wherein the bookbinding system further includes a post-processing device connected to the ring bookbinding device, a computer that controls the devices, and a display unit that displays thereon information about the abnormality provided on at least one of the preprocessing device, the post-processing device, and the computer.

7. The bookbinding system according to claim 5, wherein the punching processing unit outputs size information about an available punch size of a punch unit to the preprocessing device each time when the available punch size changes, and when the punch size information does not match with size information about rings obtained by the detecting unit and the execution of ring binding is set, the control unit displays a message saying bookbinding is not available due to mismatch in size between the rings and the punch, and when a paper size of the paper bundle matches with a punch size of the punch unit, the control unit displays a message saying punching processing function only.

8. The bookbinding system according to claim 6, wherein the punching processing unit outputs size information about an available punch size of a punch unit to the preprocessing device each time when the available punch size changes, and when the punch size information does not match with size information about rings obtained by the detecting unit and the execution of ring binding is set, the control unit displays a message saying bookbinding is not available due to mismatch in size between rings and punch, and when a paper size of the paper bundle matches with a punch size of the punch unit, the control unit displays a message saying punching processing function only.

9. The bookbinding system according to claim 5, wherein when a thickness of the paper bundle to be bound exceeds a ring diameter of the ring, the control unit displays a message saying bookbinding is not available due to excessive number of sheets, and a message saying punching processing function only.

10. The bookbinding system according to claim 6, wherein when a thickness of the paper bundle to be bound exceeds a ring diameter of the ring, the control unit displays a message saying bookbinding is not available due to excessive number of sheets, and a message saying punching processing function only.

11. The bookbinding system according to claim 9, wherein when it is determined that a number of sheets to be printed is to exceed an upper limit of number of bindable sheets, the control unit suspends the ring binding before a number of printed sheets exceeds the upper limit, and displays the messages.

12. The bookbinding system according to claim 10, wherein when it is determined that a number of sheets to be printed is to exceed an upper limit of number of bindable sheets, the control unit suspends the ring binding before a number of printed sheets exceeds the upper limit, and displays the messages.

13. A bookbinding system including a preprocessing device and a ring bookbinding device that receives a paper bundle delivered from the preprocessing device, punches a plurality of holes on a binding side of the paper bundle, and performs a ring binding by inserting a ring into each of the holes, wherein the ring binding device includes a punching processing unit to punch the holes in the paper bundle, a bookbinding unit, including a cartridge for stocking a plurality of rings, to perform a ring binding by binding the paper bundle with the rings, a detecting unit to detect an abnormality of a ring in the cartridge, and a control unit to exchange a signal from the detecting unit with a preprocessing control unit of the preprocessing device for comparison of the signal with a setting condition in the preprocessing control unit each time when detection information obtained by the detecting unit changes, and when any one of the rings is determined as abnormal based on a result of the comparison and an execution of ring binding is set, the control unit displays a message saying punching processing function only on a display unit.

14. The bookbinding system according to claim 13, wherein when a setting condition of the ring binding does not match with the detection information obtained by the detecting unit, it is determined as the abnormality of the ring.

15. The bookbinding system according to claim 13, wherein the detecting unit is configured to detect at least one piece of information among a set state, remaining-amount information, size information, and a ring diameter of the rings in the cartridge as a subject of detection of the abnormality of the ring.

16. The bookbinding system according to claim 13, wherein the bookbinding system further includes a post-processing device connected to the ring bookbinding device, and a computer that controls the devices, and the display unit is provided on at least one of the preprocessing device, the post-processing device, and the computer.

17. The bookbinding system according to claim 13, wherein the punching processing unit outputs size information about an available punch size of a punch unit to the preprocessing device each time when the available punch size changes, and when the punch size information does not match with size information about rings obtained by the detecting unit and the execution of ring binding is set, the control unit displays a message saying bookbinding is not available due to mismatch in size between rings and punch, and when a paper size of the paper bundle matches with a punch size of the punch unit, the control unit displays a message saying punching processing function only.

18. The bookbinding system according to claim 13, wherein when a thickness of the paper bundle to be bound exceeds a ring diameter of the ring, the control unit displays a message saying bookbinding is not available due to excessive number of sheets, and a message saying punching processing function only.

19. The bookbinding system according to claim 18, wherein when it is determined that a number of sheets to be printed is to exceed an upper limit of number of bindable sheets, the control unit suspends the ring binding before a number of printed sheets exceeds the upper limit, and displays the messages.

* * * * *